US006167918B1

(12) United States Patent
Moeneclaey

(10) Patent No.: US 6,167,918 B1
(45) Date of Patent: Jan. 2, 2001

(54) GRIPPER SYSTEM FOR GRIPPER LOOM

(75) Inventor: Denis Moeneclaey, Oostnieuwkerke-Staden (BE)

(73) Assignee: Picanol N.V., Ypres (BE)

( * ) Notice: Under 35 U.S.C. 154(b), the term of this patent shall be extended for 0 days.

(21) Appl. No.: 08/639,929

(22) Filed: Apr. 26, 1996

(30) Foreign Application Priority Data

May 4, 1995 (BE) ..... 9500405

(51) Int. Cl.[7] ..... D03D 47/20; D03D 47/00

(52) U.S. Cl. ..... 139/448; 139/448; 139/449; 139/196.2; 139/438

(58) Field of Search ..... 139/448, 449, 139/196.2, 438; D03D 47/20, 47/00

(56) References Cited

U.S. PATENT DOCUMENTS

| | | | | |
|---|---|---|---|---|
| 4,100,941 | * | 7/1978 | Ainsworth et al. | 139/449 |
| 4,357,964 | * | 11/1982 | Kohler | 139/448 |
| 4,690,177 | * | 9/1987 | Gehring et al. | 139/449 |
| 5,097,873 | * | 3/1992 | Muller et al. | 139/449 |
| 5,441,086 | * | 8/1995 | Nanni | 139/196.2 |

* cited by examiner

*Primary Examiner*—John J. Calvert
*Assistant Examiner*—Robert H. Moromoto, Jr.
(74) *Attorney, Agent, or Firm*—Bacon & Thomas, PLLC

(57) ABSTRACT

In a rapier for a gripper loom, the rapier is made of synthetic material and includes at least one layer of reinforcing fibers. The gripper is mounted at the front end of the rapier, and the layer of reinforcing fibers begins at a distance away from said front end.

29 Claims, 2 Drawing Sheets

GRIPPER SYSTEM FOR GRIPPER LOOM

BACKGROUND OF THE INVENTION

1. Field of the Invention

This invention concerns a gripper system for a gripper loom including a rapier of synthetic material which contains reinforcing fibers and which can be fitted with a gripper at its front end.

2. Description of Related Art

In gripper looms, weft yarns are inserted by grippers into the shed, the grippers being affixed to a flexible rapier. The rapier is driven by a drive wheel and is made to move through guides both within and outside the shed. To achieve a stable, straight gripper motion in the shed, the rapier of synthetic material of the state of the art is fiber-reinforced (RESEARCH DISCLOSURE, November 1980, pp 480, 481). To increase the rigidity of the rapier, comparatively strong reinforcing fibers are used in the rapier, for instance fibers made of carbon or kevlar.

Such a gripper system operates very satisfactorily in practice. One drawback, however, is the relatively high wear not only of the rapier, but also of the guides, especially those displaceable into the shed.

BACKGROUND OF THE INVENTION

It is an objective of the invention to provide a gripper system of the type having a rapier of synthetic material for moving a gripper into and out of the shed of a weaving machine, and in which wear of the rapier and guides therefor is reduced.

This objective is achieved by providing a rapier having reinforcing fibers situated a predetermined distance away from the front end of the rapier.

The invention is based on the insight that abrasion of the guides resulting from rapier wear, especially in the vicinity of this rapiers's front end, which has not yet led to inoperability of the gripper system, nevertheless will lay bare the reinforcing fibers in the vicinity of the front end of the rapier. The wear at the front end of the gripper system to which the gripper is affixed is caused by misalignment of the guides inserted into the shed, because the front rapier end first makes contact with these guides. The reinforcing fibers bared by such wear, especially in the zone of the rapier front end, act in a highly degrading manner on the guides, causing abrasion of the guides. AS a result, guidance of the rapier within the shed no longer is optimal, and moreover the danger increases of damaging or rupturing one or more warp yarns coming into contact with the guide elements. Also, the partly abraded guides in turn cause marked wear of the rapier, especially at its front end, as a result of which interaction takes place that increases even further the wear/abrasion of the rapier assembly.

The present invention thus offers the advantage that the guide elements are now subjected to less degradation and, as a side effect, the front rapier end in turn is also less worn because, even after some initial wear, the degrading reinforcing fibers do not reach the surface of the rapier.

In a preferred embodiment of the invention, the reinforcing fibers are mounted in one or several layers inside the rapier.

In addition, the invention provides that a stiffening rib be affixable behind the front end zone of the gripper system. This stiffening rib runs at least approximately as far as the gripper and offers the advantage that this portion of the rapier, which is less rigid because of the lack of reinforcing fibers, is reinforced adequately by the stiffening rib in order to move the gripper in a problem-free manner through a shed.

In another embodiment of the invention, the rapier is fitted, at least in an end zone of the stiffening rib situated away from the gripper, with at least one additional layer of reinforcing fibers. As a result, the junction zone between the rapier and the stiffening rib is additionally rigidified.

In a further embodiment of the invention, an exchangeable sole is mounted before the rapier front end and under the gripper, the cross-section of the sole substantially corresponding to that of the rapier. This sole forms a wearable part which can be exchanged by itself without having to exchange the rapier.

Further features and advantages of the invention are elucidated in the description below of the illustrative embodiments shown in the drawings.

DETAILED DESCRIPTION OF THE PREFERRED EMBODIMENTS

Figure 1:
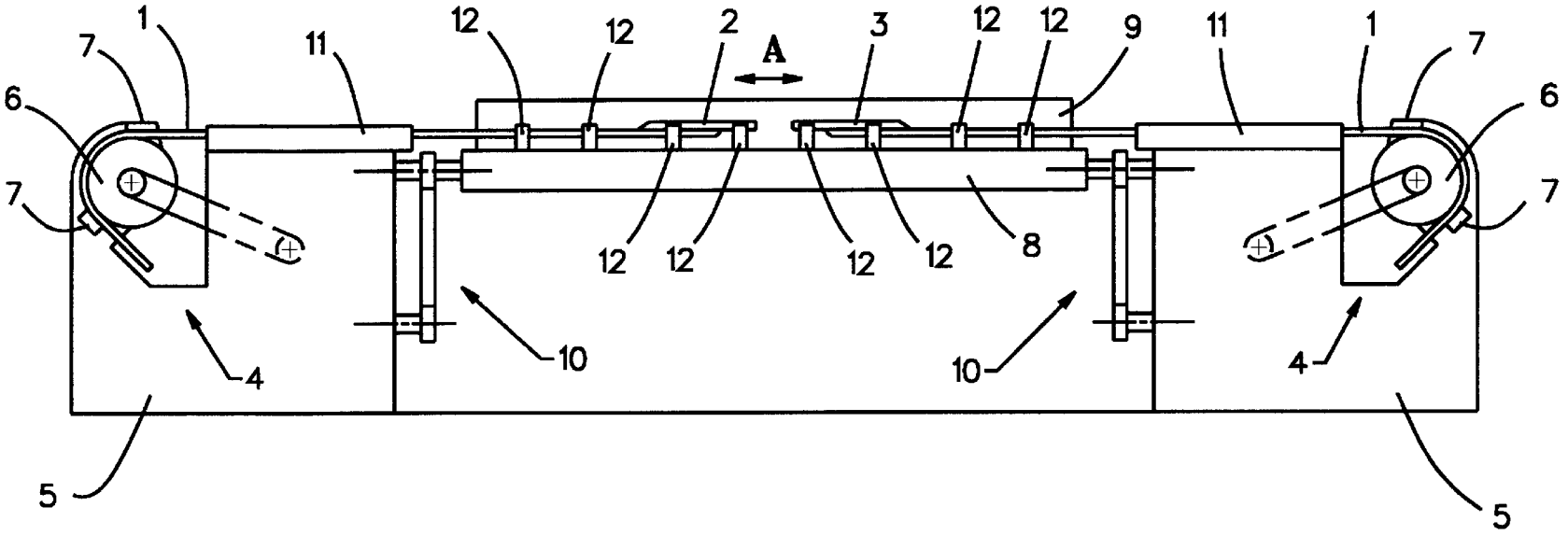
FIG. 1 is a schematic elevation of a gripper loom including a gripper system constructed according to the principles of the invention.

The gripper loom shown in FIG. 1 includes two rapiers 1, a donor gripper 2 being affixed to one rapier 1 and an receiver gripper 3 being affixed to the other rapier 1. A drive 4 moves the rapier 1 together with the donor gripper 2, and a weft yarn to be inserted in the direction of arrow A as far as the middle of the gripper loom, where the receiver gripper 3, which is displaced together with the other rapier 1 driven by a further drive 4, accepts the weft and moves it to the opposite side of the gripper loom.

The drives 4 are mounted in the area of mutually opposite side frames 5 and illustratively contain driven gears 6 cooperating with the rapiers 1. The teeth of the gears 6 enter apertures in the rapiers 1 and the rapiers 1 are kept in contact with the gears by means of guide blocks 7. A batten 8 bearing a reed 9 and resting in the side frame 5 is driven by a drive 10. The drives 4 and 10 operate synchronously.

The rapiers 1 are guided in the zone of the side frames 5 by stationary guides 11. Within the region of a shed, the rapiers 1 are guided by guides 12 which are affixed in known manner to the batten 8 and which, on the basis of batten motion, move into the shed.

Figure 2:
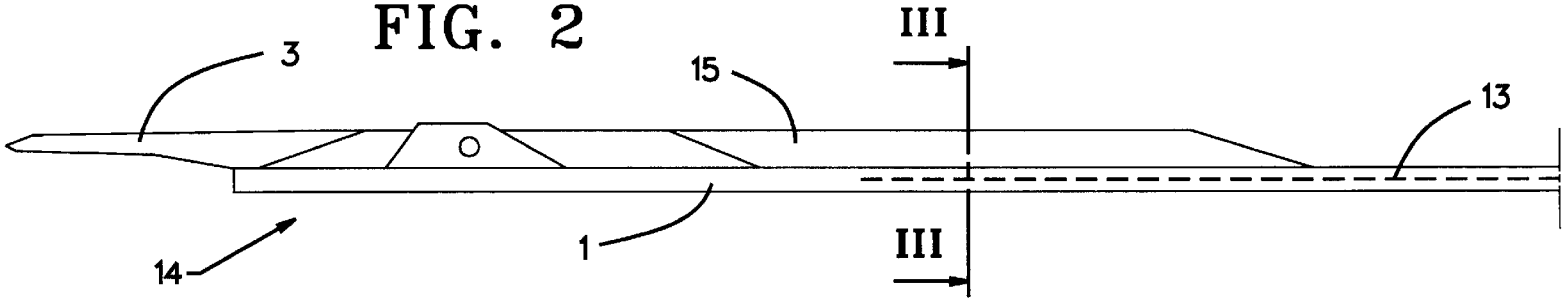
FIG. 2 is a side view on an enlarged scale of the rapier illustrated in FIG. 1, fitted with the gripper and a stiffening rib.
Figure 3:
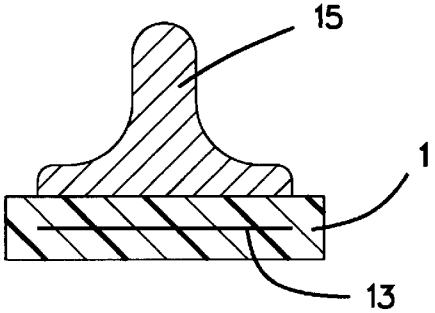
FIG. 3 is a section along line III—III of FIG. 2 on a still further enlarged scale.

As shown in FIGS. 2 and 3, the rapier 1 is made up of a synthetic base member into which is integrated a layer of reinforcing fibers 13, for instance carbon fibers. The layer of reinforcing fibers 13 is enclosed everywhere by the synthetic base member. The synthetic base member illustratively is made of a polymer having loose and non-abrasive fibers.

The synthetic base member may be a laminate composed of several mutually bonded layers. The reinforcing fibers 13 are may be in the form of loose reinforcing fibers, fiber mats, or fabrics sandwiched between two layers to which they are bonded. In the embodiment of FIGS. 2 and 3, the reinforcing fibers 13 are present in only one layer which runs across substantially the entire width of the rapier 1, and over nearly the full length of the rapier 1, except that the layer is not included within a specified distance from the front end 14 of the rapier 1, the receiver gripper 3 being affixed in the zone defined by the specified distance.

A stiffening rib 15 adjoining the receiver gripper 3 is mounted to the end 14 of the rapier 1 and constitutes a part of the receiver gripper 3 or else it is affixed to it. Stiffening rib 15 runs at least as far as the front-end zone of the layer of reinforcing fibers 13 of the rapier 1, preferably extending some further distance beyond this zone, and has a substantially inverted T-shaped cross-section, the cross-bar of the T-shape being affixed to the top side of the rapier 1 and the vertical leg of the T-shape essentially projecting centrally upward from the rapier 1.

Figure 4:
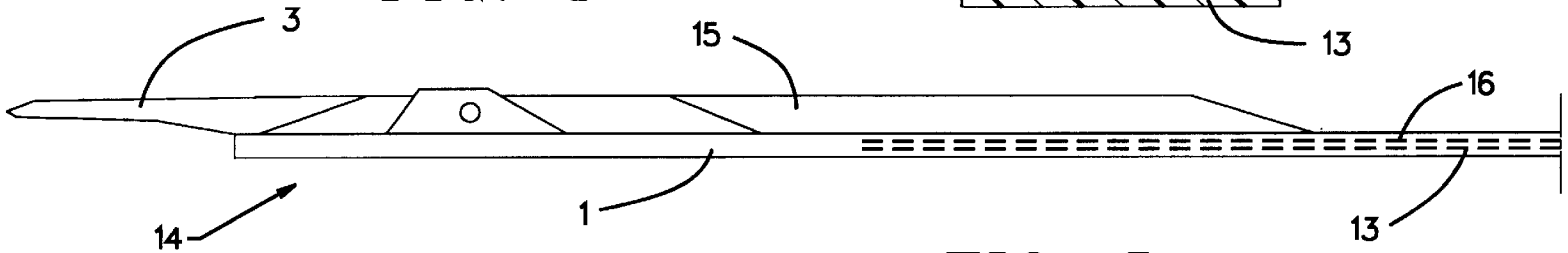
FIG. 4 is a side view similar to FIG. 2 of an embodiment with two layers of reinforcing fibers.

In the embodiment of FIG. 4, two layers of reinforcing fibers 13, 16 are integrated into the rapier 1 and, similarly to the case shown in FIGS. 2 and 3, run substantially across the full width of the rapier 1 and over nearly the full length of this rapier, in the latter case however only as far as a well defined distance from the front end 14 of the rapier 1, the receiver gripper 3 being affixed in the zone defined by the well defined distance.

In a variation of the above-described embodiments, more than two layers of reinforcing fibers are integrated into the rapier 1, each layer only running over a specified width of said rapier.

Figure 5:
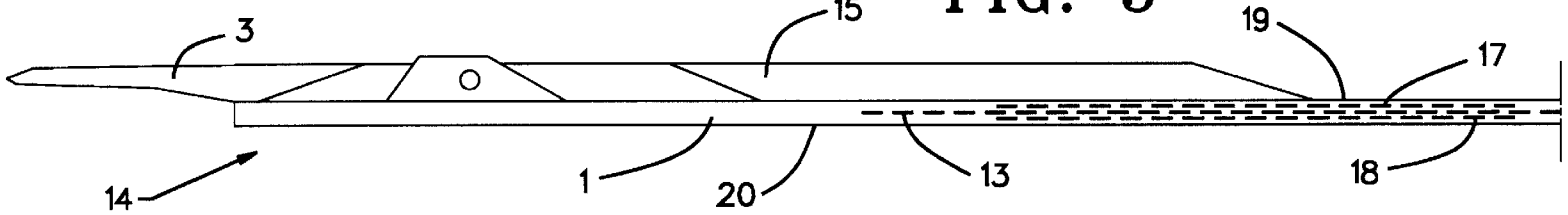
FIG. 5 is a side view of an embodiment with additional layers of reinforcing fibers in the transition zone between the rapier and the stiffening rib.

In the embodiment of FIG. 5, the rapier 1 contains a layer of reinforcing fibers 13 essentially extending across the full width of the rapier 1 but terminating longitudinally in the zone of the front end 14 before the receiver gripper 3. Two additional layers of reinforcing fibers 17, 18 are integrated into the junction zone of the stiffening rib 15 and the adjoining portion of the rapier but extend only over this zone. The two layers of reinforcing fibers 17, 18 assure that the rapier 1 is especially rigid in that portion where the stiffening rib begins. The layers of stiffening fibers 17, 18 are a larger distance away from the end 14 of the rapier 1 than is the layer of reinforcing fibers 13. This feature is especially appropriate with respect to the layer of reinforcing fibers 18 because they are situated closer to the especially wear-susceptible lower or upper side of the rapier 1 than is the layer of reinforcing fibers 13. The layers of reinforcing fibers 17, 18 may be as wide as the layer of reinforcing fibers 13, or they may be narrower.

Another embodiment similar to that of FIG. 4 includes additional layers of reinforcing fibers 17, 18 which again run only over a restricted longitudinal length.

In the embodiment of FIG. 5, the rapier 1 is fitted in the vicinity of its top side 19 and in the vicinity of its lower side 20 with layers of wear-resistant but nonabrasive material that run across and over the full width and length of the rapier 1.

In an embodiment of the invention not shown herein, the layers of reinforcing fibers 13, 16, 17, 18 run as far as the side edges of the rapier. Such a rapier would be particularly useful in the gripper loom described in European patent document A 0,620,303, in which the side edges of the rapier(s) 1 do not cooperate with the guides 12 affixed to the batten 8.

The rapier 1 for the donor gripper 2 is also designed according to the above embodiments and therefore does not need to be described separately.

Figure 6:
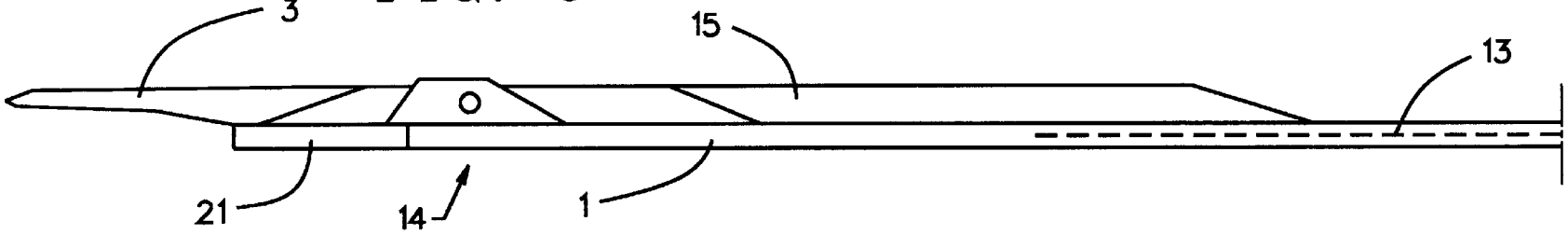
FIG. 6 is an embodiment similar to that of FIG. 2 including a sole mounted as a wear part to the gripper.

The embodiment shown in FIG. 6 includes a rapier similar to those of the embodiments of FIGS. 2 through 5. In this embodiment, a sole 21 mounted in exchangeable manner under the receiver gripper 3, or also on the donor gripper 2, is affixed ahead of the front end 14. The cross-section of this sole 21 matches that of the adjoining rapier, the sole itself being an exchangeable wear-element.

Finally, in accordance with U.S. practice, it will be appreciated by those skilled in the art that the invention is not to be necessarily limited to any of the above embodiments, but rather that the invention is to be defined by the appended claims.

I claim:

1. A gripper system for a gripper loom including a rapier adapted to be fitted with a gripper at a front end of the rapier, said rapier being made of a synthetic material and containing reinforcing fibers, the improvement wherein the reinforcing fibers are situated at a predetermined distance away from the said front end of the rapier and said front end of the rapier is therefore free of said reinforcing fibers.

2. A gripper system as claimed in claim 1, wherein the reinforcing fibers are included in at least one layer within the rapier.

3. A gripper system as claimed in claim 2, further comprising a stiffening rib mounted on the rapier in a zone behind said front end and that runs at least approximately as far as the gripper.

4. A gripper system as claimed in claim 3, wherein the stiffening rib runs from the gripper as far as a zone of the rapier in which the reinforcing fibers are contained.

5. A gripper system as claimed in claim 3, wherein the stiffening rib is mounted on an upper side of the rapier.

6. A gripper system as claimed in claim 5, wherein the stiffening rib has a substantially T-shaped cross-section and is connected by a cross-bar of the T-shape to the upper side of the rapier.

7. A gripper system as claimed in claim 3, wherein the stiffening rib is part of the gripper.

8. A gripper system as claimed in claim 3, wherein at an end zone of the stiffening rib away from the gripper the rapier is fitted with at least one additional layer of reinforcing fibers.

9. A gripper system as claimed in claim 3, further comprising an exchangeable sole mounted under the gripper in front of the front end of the rapier, a cross-section of said sole substantially matching that of the rapier.

10. A gripper system as claimed in claim 1, further comprising a stiffening rib mounted on the rapier in a zone behind said front end and that runs at least approximately as far as the gripper.

11. A gripper system as claimed in claim 10, wherein the stiffening rib runs from the gripper as far as a zone of the rapier in which the reinforcing fibers are contained.

12. A gripper system as claimed in claim 10, wherein the stiffening rib is mounted on an upper side of the rapier.

13. A gripper system as claimed in claim 12, wherein the stiffening rib has a substantially T-shaped cross-section and is connected by a cross-bar of the T-shape to the upper side of the rapier.

14. A gripper system as claimed in claim 10, wherein the stiffening rib is part of the gripper.

15. A gripper system as claimed in claim 10, further comprising an exchangeable sole mounted under the gripper in front of the front end of the rapier, a cross-section of said sole substantially matching that of the rapier.

16. A gripper system as claimed in claim 1, further comprising an exchangeable sole mounted under the gripper in front of the front end of the rapier, a cross-section of said sole substantially matching that of the rapier.

17. A rapier having a front end adapted to be fitted with a gripper, said rapier being made of a synthetic material and containing reinforcing fibers, the improvement wherein the reinforcing fibers are situated at a predetermined distance away from the said front end of the rapier and said front end of the rapier is therefore free of said reinforcing fibers.

18. A rapier as claimed in claim 17, wherein the reinforcing fibers are included in at least one layer within the rapier.

19. A rapier as claimed in claim 18, further comprising a stiffening rib mounted on the rapier in a zone behind said front end and that runs at least approximately as far as the gripper.

20. A rapier as claimed in claim 19, wherein the stiffening rib runs from the gripper as far as a zone of the rapier in which the reinforcing fibers are contained.

21. A rapier as claimed in claim 19, wherein the stiffening rib is mounted on an upper side of the rapier.

22. A rapier as claimed in claim 21, wherein the stiffening rib has a substantially T-shaped cross-section and is connected by a cross-bar of the T-shape to the upper side of the rapier.

23. A rapier as claimed in claim 19, wherein the stiffening rib is part of the gripper.

24. A rapier as claimed in claim 19, wherein at an end zone of the stiffening rib away from the gripper the rapier is fitted with at least one additional layer of reinforcing fibers.

25. A rapier as claimed in claim 17, further comprising a stiffening rib mounted on the rapier in a zone behind said front end and that runs at least approximately as far as the gripper.

26. A rapier as claimed in claim 25, wherein the stiffening rib runs from the gripper as far as a zone of the rapier in which the reinforcing fibers are contained.

27. A rapier as claimed in claim 25, wherein the stiffening rib is mounted on an upper side of the rapier.

28. A rapier as claimed in claim 27, wherein the stiffening rib has a substantially T-shaped cross-section and is connected by a cross-bar of the T-shape to the upper side of the rapier.

29. A rapier as claimed in claim 25, wherein the stiffening rib is part of the gripper.

* * * * *